US008875433B2

(12) United States Patent
Beckman

(10) Patent No.: US 8,875,433 B2
(45) Date of Patent: Nov. 4, 2014

(54) FIREARM LOADING TECHNIQUES ELIMINATING FIRING PAUSE AND ENABLING RAPID PARTIAL SOURCE REPLACEMENT AND LOAD SUPPLEMENTATION PRIOR TO EMPTY

(71) Applicant: Christopher V. Beckman, San Diego, CA (US)

(72) Inventor: Christopher V. Beckman, San Diego, CA (US)

( * ) Notice: Subject to any disclaimer, the term of this patent is extended or adjusted under 35 U.S.C. 154(b) by 38 days.

(21) Appl. No.: 13/656,707

(22) Filed: Oct. 20, 2012

(65) Prior Publication Data

US 2014/0109451 A1 Apr. 24, 2014

(51) Int. Cl.
*F41A 9/83* (2006.01)

(52) U.S. Cl.
USPC ..... 42/87; 42/49.02; 42/6; 89/1.4; 89/45

(58) Field of Classification Search
USPC ..... 42/6, 49.02, 87; 89/1.4, 45
See application file for complete search history.

(56) References Cited

U.S. PATENT DOCUMENTS

| | | | | |
|---|---|---|---|---|
| 708,794 | A | 9/1902 | Browning | |
| 4,115,943 | A | 9/1978 | Musgrave | |
| 4,706,402 | A * | 11/1987 | Csongor | 42/87 |
| 5,052,138 | A * | 10/1991 | Crain | 42/1.02 |
| 5,806,224 | A | 9/1998 | Hager | |
| 6,481,136 | B1 | 11/2002 | Fitzpatrick | |
| 6,502,495 | B1 | 1/2003 | Beary | |
| 6,601,496 | B1 | 8/2003 | Kalashnikov | |
| 6,898,888 | B2 | 5/2005 | Greenhut | |
| 7,975,420 | B2 | 7/2011 | Pestana | |
| 8,069,601 | B1 | 12/2011 | Fitzpatrick | |
| 2011/0113668 | A1 | 5/2011 | Pestana | |
| 2011/0258898 | A1 * | 10/2011 | Chiappini et al. | 42/6 |
| 2012/0073429 | A1 | 3/2012 | Bowles | |

OTHER PUBLICATIONS

Product Literature re: CAA Tactical's Mag 17, available at http://www.caatactical.com/viewProduct.asp ID=351&catID=318, accessed Sep.17, 2012.

* cited by examiner

*Primary Examiner* — J. Woodrow Eldred

(57) ABSTRACT

The present invention involves techniques for rapid, flexible, partial and supplemental reloading of firearms using specialized actions, intermediate storage devices/feeds and multiple magazines, which may, in some embodiments, be simultaneously engaged with a firearm. The techniques disclosed include a feeding system, which may be a multiple-magazine feeding system, that allows a firearm to remain loaded and firing-ready with multiple loaded cartridges at all times, even during reloading operations. The invention also includes other techniques for flexible, non-wasteful, partially-empty reloading, to eliminate reloading paralysis, and allow the soldier or other user, not the size of a magazine, to determine when firing should continue and when and if it should pause.

20 Claims, 9 Drawing Sheets

FIREARM LOADING TECHNIQUES ELIMINATING FIRING PAUSE AND ENABLING RAPID PARTIAL SOURCE REPLACEMENT AND LOAD SUPPLEMENTATION PRIOR TO EMPTY

FIELD OF THE INVENTION

The present invention relates to the field of firearms and ammunition storage and deployment systems. More specifically, the invention relates to the sub-field of ammunition magazines.

BACKGROUND

In modern automatic and semi-automatic firearms, reloading is frequently accomplished by an ammunition storing and deploying component known as an ammunition magazine ("magazine"), which stores a series of ammunition cartridges that may be serially fed into the firearm chamber for firing. In some firearms, magazines are fixed to the firearm, meaning that they are not designed to be removed and replaced with other magazines rapidly by a standard user operation during use of the firearm, and/or without separate tools. Some firearms implement detachable magazines, which, by contrast, may be removed and replaced during firearm use by a standard user operation during use of the firearm, without separate tools.

Firearms used in combat and other situations with potentially heavy crossfire often incorporate detachable magazines, because the serial reloading of cartridges into a fixed magazine would require too much time during use of the firearm and jeopardize the safety of the user. In such situations, a user may carry several fully loaded, detached magazines to rapidly, fully reload the firearm during engagement. Firearms using fixed magazines are better adapted to sporting or remote use (such as hunting or sniping), but even in those contexts, a detachable exchangeable magazine firearm is often used.

Both detachable and fixed magazines are typically rectangular or curved (in the instance of "banana" style clips) boxes, incorporating a spring that applies force to a movable piece called a "follower" attached to the spring, for feeding cartridges into a firing chamber, seriatim, from a magazine port, which typically has a lip (or lips) partially closing it for the retention of the cartridges until they are fed into the firing chamber. A bolt or other feeding and/or firing mechanism action may enter an open part of the port to catch an edge of, and push, a cartridge through another more open part of the port, sliding it out of the magazine and into the firing chamber (after removing a shell casing from the firing chamber, if necessary). But magazines may take a wide variety of other forms, including cylindrical shapes, without springs and followers. See, e.g., U.S. Pat. No. 6,502,495. Typically, when a magazine has been emptied by use of the firearm, a last, remaining bullet may still occupy the firing chamber, until it is fired. In some magazine systems, firing that final cartridge will result in the bolt and/or action being "locked open" to signify that the magazine is empty and requires reloading or replacement. See id.; see also U.S. Pat. No. 708,794, to Browning (patent for the Colt Model 1902, which included last shot hold-open) (claim 3).

In some magazine systems, the magazine may at least roughly indicate the amount of ammunition remaining loaded in a magazine, for instance, by a "window" or other indicator of the degree to which the magazine is filled with ammunition or the degree to which the follower and/or spring have risen in the magazine due to the removal of ammunition. See, e.g., Product Literature re: CAA Tactical's Mag 17, available at http://www.caatactical.com/viewProduct.asp?ID=351&catID=318, accessed Sep. 17, 2012.

A wide variety of magazine stowing and deployment easing solutions have also been invented, such as belts, pockets, holsters and grips. Such systems may aid soldiers and other firearms users in accessing and replacing magazines. See, e.g., U.S. Pat. No. 6,481,136.

SUMMARY OF THE INVENTION

The present invention involves techniques for rapid, flexible, partial and supplemental reloading of firearms using new, specialized actions, intermediate storage devices, cartridge feeding systems and/or magazines, which may be multiple, simultaneously engaged magazines. The techniques disclosed include multiple-magazine, multiple compartment and/or multiple feed systems, that allow a firearm to be flexibly and/or partially reloaded, load-completed, and loaded and firing-ready with multiple loaded cartridges at all times, provided enough ammunition magazines are on hand—even during a reloading operation. The invention also includes other techniques for flexible, non-wasteful partially-empty reloading or load completion, including an automatic magazine selector, ejector and ammunition counter and communication system, to aid in optimizing the use of aspects of the invention.

Among other objects, the embodiments of the invention eliminate and/or substantially reduce reloading paralysis, and allow a soldier or other user, not the size of a magazine, to better determine when, if, how often and how much firing will pause and continue.

DETAILED DESCRIPTION OF THE INVENTION

Figure 1:
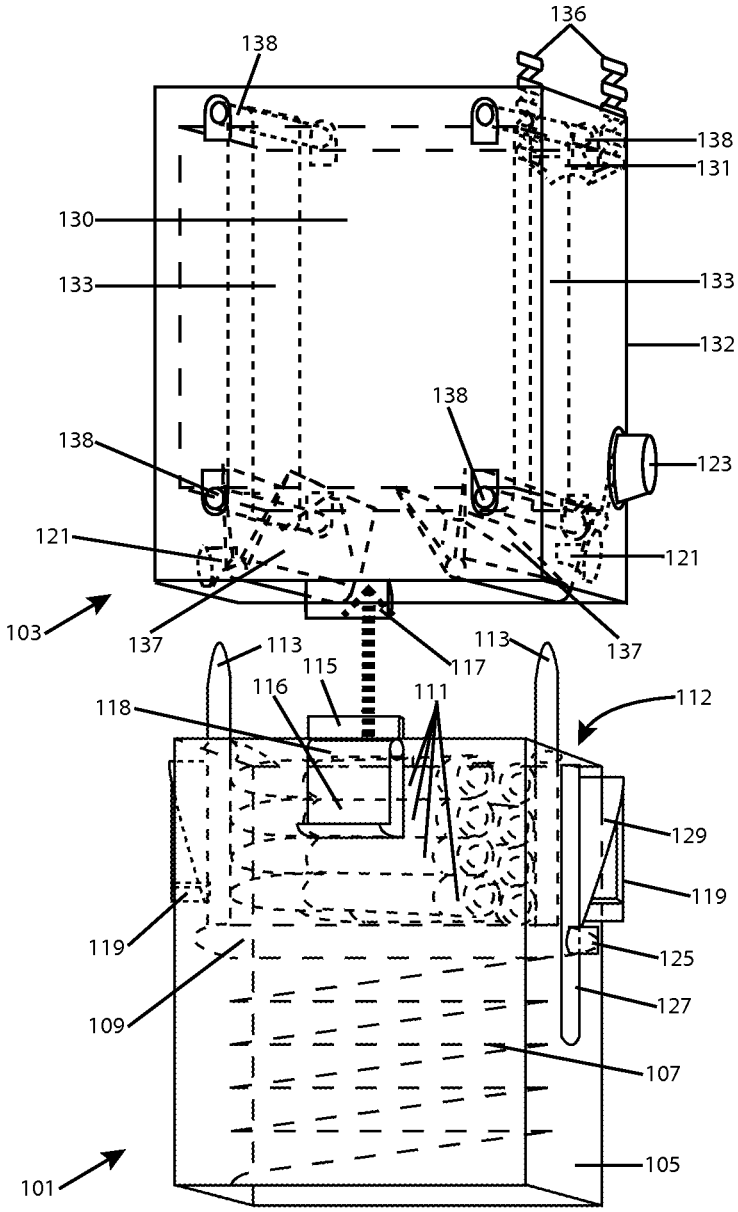
FIG. 1 is a perspective illustration of aspects of a flexible-loading ammunition system, including an ammunition magazine and a pre-firing cartridge feed and storage antechamber, in accordance with aspects of the present invention.

FIG. 1 is a perspective illustration of aspects of a flexible-loading ammunition system, including an ammunition magazine 101 and a pre-firing cartridge feed and storage antechamber 103, in accordance with aspects of the present invention. The magazine 101 comprises an approximately 5-sided-box-shaped and an at least semi-rigid outer housing structure 105. However, components of magazine 101, such as housing structure 105, may comprise any suitable material(s), shapes or configurations for ammunition magazines. A force-loading mechanism (such as a spring) 107 applies force to a follower 109, which, in turn, holds and applies upward force on loaded firearm cartridges, such as those examples pictured as 111, toward the at least partially open top-end 112 of the magazine 101. Attached to, against or in communication with follower 109 are pressure-exerting, raisable/descendible posts 113. A spreadable/contractable cartridge-securing tab (or tabs), such as 115, retain cartridges loaded in the magazine 101, unless and until magazine 101 is itself loaded into antechamber 103, in which case, as discussed in greater detail, below, the tab or tabs are spread open by the loading action.

Securing tab(s) 115 allow cartridges to be loaded straight-down into magazine 101, which is faster than the 2- or 3-step push-and-slide loading action of most magazines, because tab(s) 115 hold a top cartridge evenly, at the lengthwise center of the spring- and follower-exerted force, rather than from the rear end of the casing as in conventional magazine lips. In some embodiments, during loading, a user may use a handle 116 of tab(s) 115 to aid in clearing the loading-, otherwise open-top-end of disengaged magazine 101. In the figure, the handle 116 is shown pressed against the outer housing of the magazine 101, leading tab 115 to pivot upward, clearing the opening for loading/unloading of cartridges. But, force-biasing of the pivot point or hinge 118 would otherwise cause clockwise rotation of the tab, at least until sufficiently closing port 112 to hold cartridges in the magazine. Aso, preferably, no such exposed tab actuator handle aspect is accessible to the user and, when loading, a user simply forces a cartridge past the tab, for example, by a one-way stop shape and outward compressibility of the tab(s), or other flexible release in the direction of loading, which does not allow the tab(s) 115 to release cartridges toward the top-end 112, unless and until the magazine itself has been loaded into and fully engaged and seated with antechamber 103, which clears the tab(s) from the unloading passage of cartridges via an internal tab-clearer 117, which may be sloped to lead to pressing the tab(s) or rotating it out of the way of the port, such that it/they may permit the passage of cartridges. Although it may provide some loading convenience, the lack of an exterior handle 116 is preferred, especially in combat settings, because it may be inadvertently actuated in combat, causing the unintended emptying of the magazine 101.

Upon loading magazine 101 with cartridges, such as those pictured as 111, and which are held in place by tabs 115, the magazine may itself be loaded into an intermediate storage and advancement antechamber 103, via the engagement of complementary loading external magazine catch(es) 119 and internal antechamber catch(es) 121. When properly so locked in place and mounted, and functioning properly, the magazine 101 may be considered properly engaged with both the antechamber and the firearm. A button release, such as that pictured as 123, may allow a user to disengage and release the magazine, after it is properly engaged. But preferably, upon fully unloading, a rising tab 125 in an outer housing channel 127 also automatically depresses catch 119, gravitationally releasing magazine 101, by engaging a ramp 129 attached to or part of catch 119 as the tab 125 rises. In order to rise along with unloading of the magazine 101, tab 125 is preferably attached to follower 109, and extends outside housing 105 through channel 127.

Once loaded into antechamber 103, magazine 101 is opened by tab clearer(s) 117, and may unload a cartridge or cartridges into a cartridge-holding section 130 of antechamber 103, if, and only if, holding section 130 is not already maximally filled with cartridges, which would then exert pressure against cartridges within the magazine, retaining them there despite their upward forcing by force-biasing 107 and follower 109. Preferably, antechamber 103 is an integral part of a firearm, feeding cartridges into a firing chamber (not pictured) from the top-end of the antechamber. However, in some embodiments, both antechamber 103 and magazines such as 101 may be retrofitted onto, or used as a temporary attachment to, existing firearms, in place of an ordinary magazine. In the latter case, the structural features (e.g., magazine release and attachment features, insertion shape, etc.) would be modified from that pictured, to suit the magazine-loading requirements of each such existing firearm. Even if antechamber 103 were fully loaded when magazine 101 properly engaged with antechamber 103, magazine 101 would begin to feed cartridges into antechamber 103 as cartridges are emptied from the antechamber by firing or other bolt action, which clears space for more cartridges in the antechamber. At such time, spring 107 and follower 109 are no longer pushing cartridges against filled space in the antechamber, and, as a result, may shove cartridges into it.

As magazine 101 so unloads its cartridges into antechamber 103, force-exerting posts 113 may rise with follower 109, to which they may be attached, and, as a result, may engage with and apply upward force against post holders 131, within antechamber 103. Post holders 131 are attached to the outer-side (facing the inner-side of housing 132) of belts 133 within antechamber 103, which belts wrap around, and may advance along, belt-advancing rollers 138, which may be mounted in, and rotate within, housing 132. Also attached to the holders, belts and/or rollers are advancing spring(s) 136 (or other such force biasing) which apply downward force, counter to, but insufficient to overcome, the force exerted by posts 113 against holders 131. As a result, the upward force of rising posts 113 may cause post holders 131 to rise and the left- and right-hand-side (from the perspective of the figure) belts 133 to rotate clockwise and counterclockwise respectively. The inward sides of each belt, in turn, are attached to risable one-way bottom-defining members 137 of the antechamber holding section 130. Such bottom-defining members 137 may be flexible and one-way sloped and channeled, and allow cartridges to be loaded into section 130, but they do not allow cartridges to exit in the direction that they were loaded in the event that magazine 101 is detached, for example, because a magazine such as 101 has been emptied and disengaged and/or the user elected additional loading prior to empty of either the magazine 101 and/or antechamber 103. And even if magazine 101 is detached from antechamber 103, and no cartridge loading or advancing force is therefore exerted by spring 107, springs 136 serve to advance cartridges remaining in antechamber 103, allowing continued firing even before new magazines, such as 101 are fetched and loaded.

It should be understood that the particular embodiments set forth in this figure, and elsewhere in this application, are exemplary only, and that aspects of the invention may be carried out with a wide variety of alternative particular shapes, materials, configurations, orders and sequences than that particularly described, and still fall within the scope of the invention. Nothing in the description should be construed as a disclaimer or removal of such alternatives.

Figure 2:
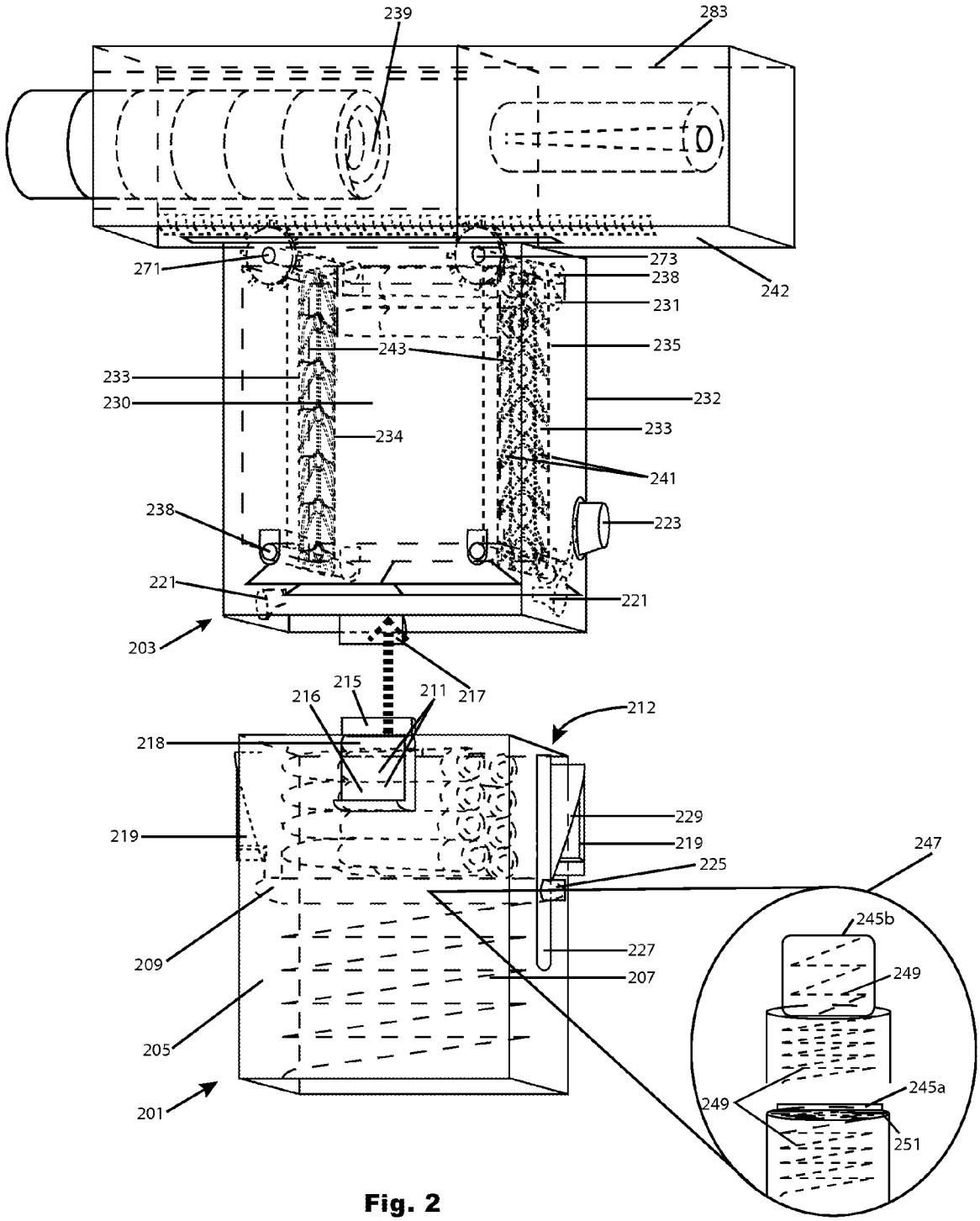
FIG. 2 is a perspective illustration of another flexible-loading ammunition system, including, but not limited to, other embodiments of an ammunition magazine and a pre-firing cartridge feed and storage antechamber, in accordance with aspects of the present invention.

FIG. 2 is a perspective illustration of another flexible-loading ammunition system, including an ammunition magazine 201 and a pre-firing cartridge feed and storage antechamber 203, in accordance with aspects of the present invention. Magazine 201 and antechamber 203 may have external dimensions similar to magazine 101 and antechamber 103, of FIG. 1, but some alternative internal mechanism embodiments are shown, and will be explained in greater detail, below. For clarity and consistency in reference, identical and/or similar structures in both FIG. 1 and FIG. 2 have been given the same latter two digits.

As with FIG. 1, force-loading 207 applies force to a follower 209 within magazine 201 to drive cartridges into antechamber 203, when antechamber 203 is properly engaged with magazine 201. In the instance of FIG. 2, however, a different one-way cartridge capturing and advancing mechanism within antechamber 203 is used to hold and drive cartridges into a firing chamber, an example of which is now shown in FIG. 2 as 239. More specifically, pairs of flexible or pivotable one-way guiding and one-way holding tabs, such as those shown as 241, attached to the outer surfaces of drivable belts 234 and 235 and shown on the faces of the belts facing inward, toward an ammunition storage cavity 230, guide cartridges driven into antechamber 203 by magazine 201 by flexing or pivoting upwards when cartridges are pressed upwards (and no cartridge is loaded in the position immediately above) against the lower surfaces of tabs 241 by follower 209. This loading configuration allows each cartridge to pass until it collides with a previously passed cartridge occupying space above it, or the bottom wall of the moveable bolt 242, if closed at that time. One way stopping walls, such as those shown as 243, prevent cartridges from escaping antechamber 203 downward, by holding tabs 241 against their bottom-facing surfaces, even if not held by the follower or cartridges driven by the follower, of magazine 201, which itself may or may not remain properly engaged with antechamber 203, depending on the operating phase of the firearm. To aid in seeing their operation and cartridge holding and advancing features, details of belts 234 and 235 are shown in greater detail in FIGS. 3 and 4.

A follower extender 245, shown in both compressed, 245*a*, and extended, 245*b*, configurations, is shown in zoom window 247. Depending on the amount of ammunition loaded in cavity 230, the follower extender 245 may extend upward past the housing 205 of magazine 201, and into antechamber 203 to drive cartridges more deeply into storage cavity 230. For example, if antechamber 203 were partially loaded with two rounds of ammunition, cartridges would occupy the top-most two positions defined by tabs 241 for holding cartridges. To prevent the creation of any gaps, for example, by insufficient cartridges being pushed from the magazine 203 to occupy all available positions in storage cavity 230, the follower extender 245 extends and drives as deeply as necessary until the last loaded cartridge from the magazine 201 abuts a loaded cartridge in antechamber 203, leaving no gaps between cartridges loaded in antechamber 203. To accomplish this follower extension, additional force-loading 249, dedicated to extending follower extender 245, and stretchable or unfoldable walls 251, enable a defined additional extension, which at least partly may occur when cartridges no longer fully compress follower extender 245, for example, by the release of variable cartridge holding tabs, as discussed in FIG. 1 and now shown as 215, and held cartridges, into a void within 230 in the engaged antechamber.

In the instance of the mechanism shown in FIG. 2, belts 234 and 235 are preferably not driven by force-loading from the magazine, 201. Instead, the automatic action of the firearm bolt drives belt-advancing gears 271 and 273, each of which drives one of belts 234 and 235 in opposing rotational directions (and only in those directions, for example, by a ratcheting mechanism engaged with the firearm action) and, in each full movement (fore and aft) of the cartridge-loading slide/bolt 283, belts 234 and 235 advance upward one cartridge position and load the top-most cartridge into the firing chamber.

In some aspects of the present invention, the loading opening of antechamber 203 may be at or more toward the top of the antechamber, rather than at the bottom, which may also aid in eliminating firing gaps in a cartridge conveyer system, such as that discussed with reference to FIGS. 2-4. FIG. 5, in part, depicts aspects of such an alternative embodiment.

Figure 3:
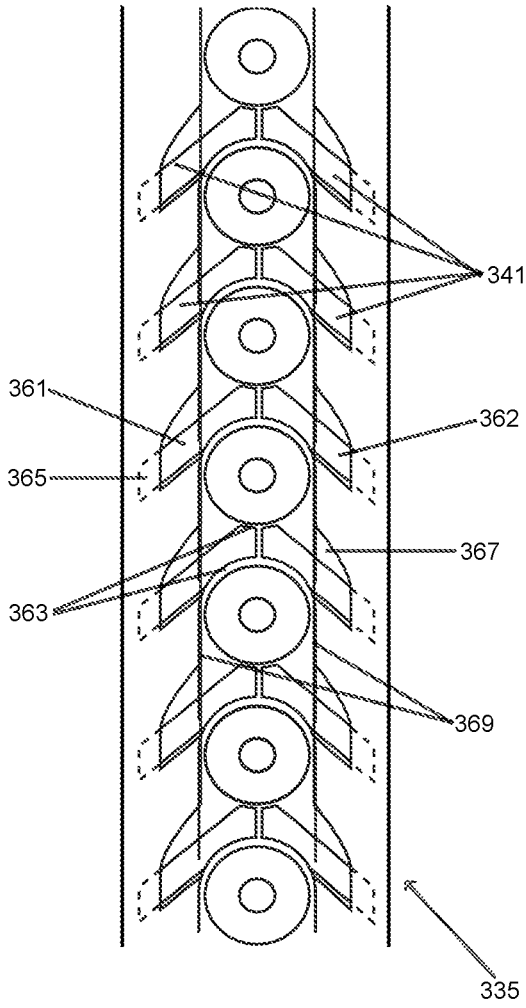
FIGS. 3 and 4 illustrate amplified feature details of cartridge advancing belts, which were previously shown in FIG. 2.
Figure 4:
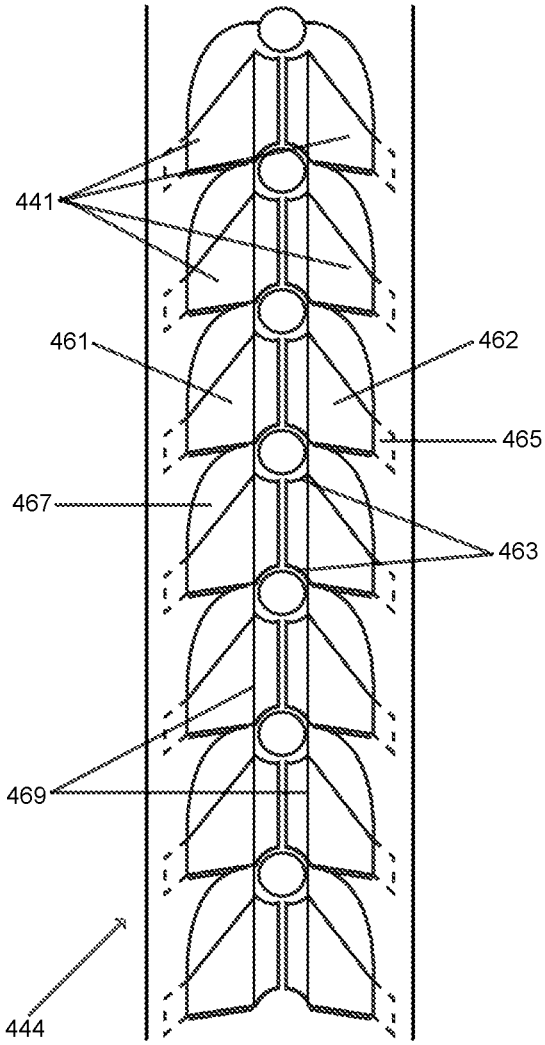
Figure 5:
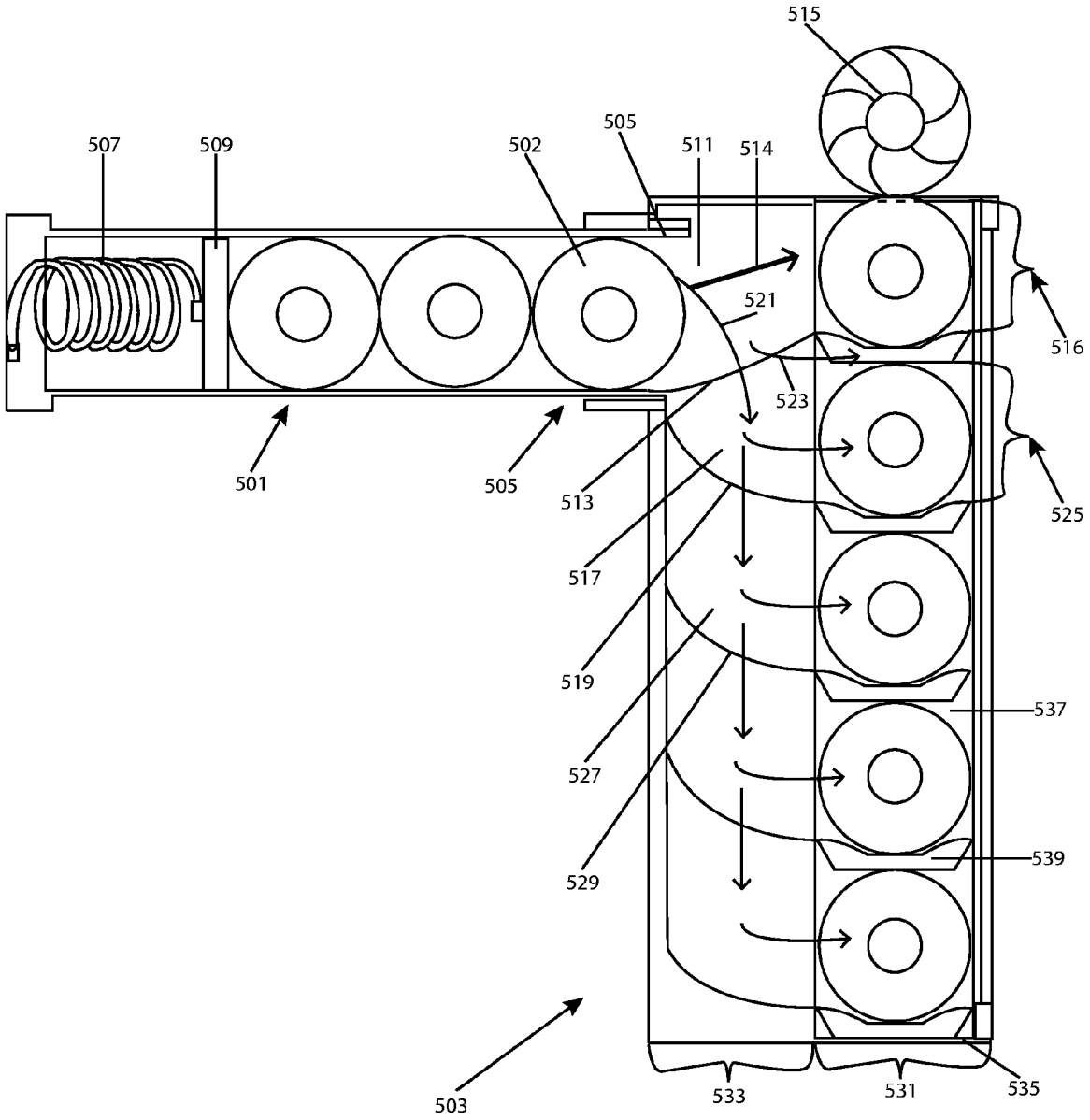
FIG. 5 is a side-view of an alternative embodiment for the antechamber of a flexible-loading ammunition system, in accordance with aspects of the present invention.

FIGS. 3 and 4 provide an illustration of amplified feature details of cartridge advancing belts 335 and 444, which were previously shown as belts 235 and 234 of FIG. 2, respectively. FIG. 3 provides a front view of the inward-facing side of the rear (butt-end) side advancing belt 335, while FIG. 4 provides a front view of the inward-facing side of the left-hand side advancing belt 444. Both drive belts, 335 and 444, contain flexible or rotatable cartridge holding tabs, shown as 341 and 441, respectively. Both sets of tabs are in pivotable or flexible converging mirror-image structure pairs of left- and right-hand side tabs, such as those shown as 361 and 362 and 461 and 462. The tabs, again such as examples 341 and 441, may be pivotably attached (e.g., by hinges) or flexibly attached (e.g., by bonding or barb) or otherwise attached to the remainder of belts 335 and 444 at attachment points/pockets, such as those shown as examples 365 and 465 of the belts 335 and 444. If a pivotable attachment is not used, preferably, tabs 341 and 441 and/or the remainder of the belts are made of a flexible material. In any event, ridges of tabs 341 and 441 grip edges of properly-loaded cartridges, as shown with reference to FIG. 2, and, because the pairs of mirror-image structured tabs converge more tightly against one another when pressed down, tabs 341 and 441 resist and/or prevent the passage of cartridges downward, holding them in place against gravity and other downward forces. If cartridges are pressed upwards, however, the set of mirror-image tabs above the cartridge will rotate and/or flex, permitting cartridges to move upward to the next higher position—if, and only if, that next higher position is empty. Sweep-permitting cavities 367 and 467 may assist in permitting the upward sweep and divergence of tabs 341 and 441 when so upwardly pressed.

Each belt may also include additional cartridge gripping ridges, such as those shown as examples 363 and 463 and side walls 369 and 469, each of which may be manufactured by cut away, injection-molding or otherwise by creating a relief from at least part of the flexible materials of at least part (such as the tabs) of the belts 335 and 444 themselves. These ridges 363 and 463 are in the outline of the ends of a cartridge to be gripped and advanced by belts 335 and 444, and aid in demonstrating the properly loaded position of such cartridges. More specifically, ridges 363 provide a gripping outline that may partially surround and hold the butt-end of loaded cartridges, while ridges 463 are shaped to complement the pointed, target-facing end of the bullet or cartridge, holding it in place.

Each of the tabs, such as examples 341/441, gripping tab ridges, such as examples 363/463, and gripping wall ridges, such as examples 369/469, vary between belt 335 and 444 to accommodate and hold the different shape of cartridges at the points held. It should be understood that such gripping and holding features may vary further as they extend outward (out-of-the-page of the figure) to accommodate and better complement and hold varying shape of a cartridge along its length. No particular size of such protruding features need be used but, preferably, the size of such features, in conjunction with the force dynamics of the belts and mechanism allow for easy movement of the belts around wrapping/turning elements at the tightness that they are used, while still allowing the advancing elements to drive the belts with sufficient, reliable grip. Also preferably, such protrusions and the material of which they are made permit them to flatten to some degree when wrapped around rotating belt-moving elements, to ease in wrapping about rollers or other turns in their movement, as may be necessary in particular embodiments of the invention. Of course, the precise shapes and sizes of the cartridge-complementary elements of the invention may differ substantially from those pictured in the figures, to complement and control the type(s), size(s) and shape(s) of ammunition components subject to the particular embodiment and the precise embodiment shown in FIGS. 2-4 are illustrative only.

FIG. 5 is a side-view of an alternative embodiment for the antechamber of a flexible-loading ammunition system. More specifically, a side-/top-loading magazine configuration, as opposed to the bottom-loading systems of FIGS. 1-4, is shown. Variably-attached side-/top-loading magazine(s), such as that pictured in an engaged position as 501, are conjoinable with a multiple-row channeled antechamber 503 at a side-top port 505, at or about the end of antechamber 503 closest to a firing chamber. Such side-/top-loading magazines may be variably locked with locking and release mechanisms such as those discussed with respect to FIGS. 1-4, for example, or any of several other known physical member locking/unlocking mechanism(s), though the mechanisms discussed specifically in this application are preferred. Upon properly engaging with antechamber 503, magazine 501 may be caused to release cartridges into antechamber 503, for example, by a variable insertion-released holding tab(s) or other mechanism that is released upon proper engagement, such as, for example, the cartridge magazine loading tab release mechanisms of the types discussed with respect to FIG. 1. As a result, force-loading 507 within magazine 501 causes a follower 509 to push cartridges into upper channel 511, defined by channel wall(s), ridge(s) or groove(s), such as that shown as 513, and in the direction of force arrow 514. If penultimate cartridge holding position 516 (prior to entering the firing chamber 515) is empty, this leads the first such loaded cartridge to be placed into that position. If, however, a cartridge is already present in position 516, the unreleased pressure against the next loaded cartridge leads that next cartridge to overcome the confines of channel wall, ridge and/or grooves such as 513, escaping downward into secondary channel 517, defined by channel wall(s), ridge(s) or groove(s) such as that shown as 519. The series of resulting forces exerted up to that point is thus approximately shown by force arrows 521 and 523. Force arrows 521 and 523 may also depict the motion of the cartridge unless the third-to-last position (second prior to the firing chamber) 525, is occupied, as the penultimate position to firing chamber was. If position 525 is so occupied, the cartridge may again be forced out of its new channel, 517, and again be forced downward into the next downward auxiliary channel, this time 527, defined by channel wall/groove 529, and so on with further channels below, until a position in the right-hand side row 531 of cartridges is open to receive the cartridge, or the cartridge reaches the bottom wall 535 of the antechamber 503. As with the mechanism depicted and discussed with respect to FIG. 2, a conveyor belt or belts 537 with cartridge holding features, such as the example provided as 539, preferably advanced one position upward per round of fire upon the action of the bolt/firing chamber clearing mechanism, also as in FIG. 2, is used to advance the cartridges held in row 531 to the firing chamber. In the embodiment of FIG. 5, however, holding tabs need not allow upward passage of rounds from below. Preferably, all of the channel walls, ridges and/or grooves are made of elastomeric, low-friction material and/or shaped to create primarily right-wards, and, secondarily (in terms of pushing strength), downwards pressure on cartridges within the channel, such that other force loading from the magazine is not required to continue feeding all cartridges into the firing chamber 515 upon sufficient firing. However, such force loading may additionally or alternatively be used to exert the channeling-related forces, and force arrows, discussed above.

Figure 6:
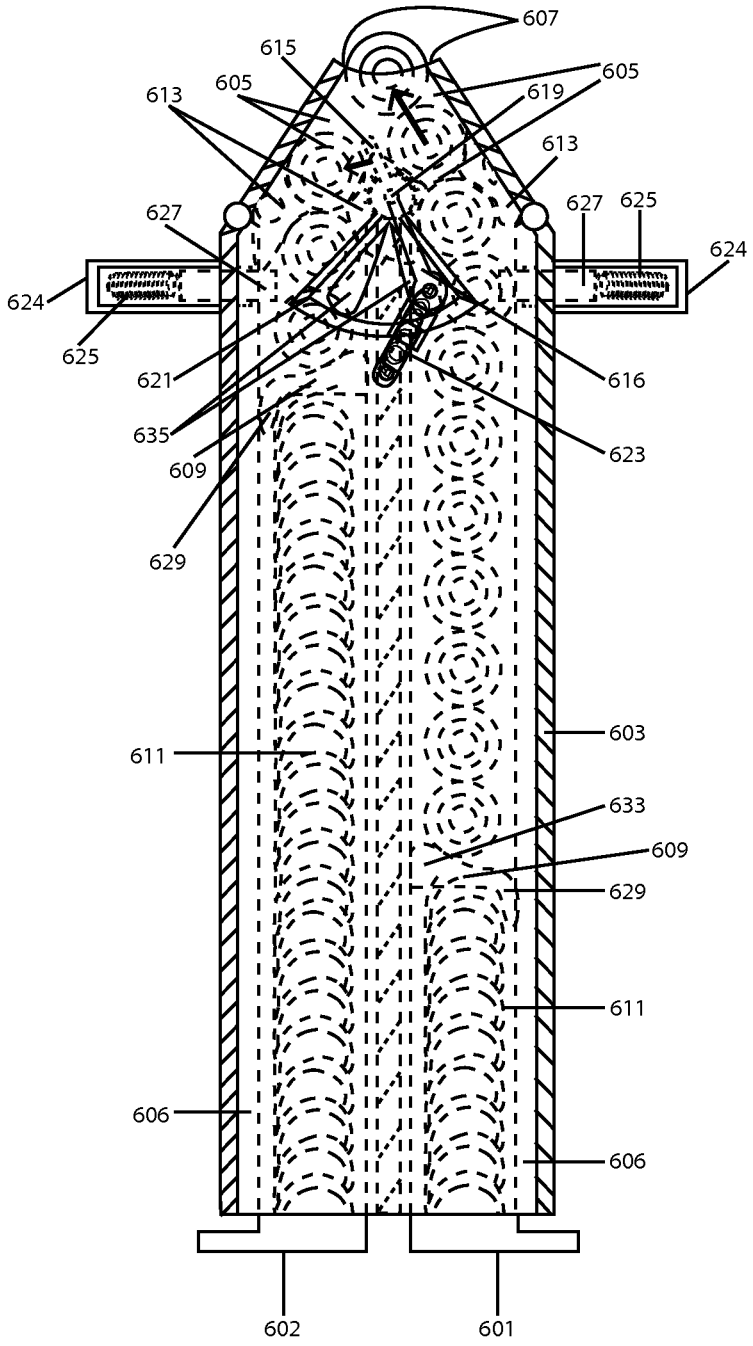
FIG. 6 is a side view of another flexible-loading ammunition system, including, but not limited to, a set of dual, separately changeable ammunition magazines and a pre-firing magazine receiving housing, comprising a cartridge feed and storage volume, in accordance with aspects of the present invention.

FIG. 6 is a side view of another flexible-loading ammunition system, including a set of dual, separately changeable ammunition magazines 601 and 602 and a pre-firing magazine receiving housing 603, comprising a cartridge feed and storage volume 605, in accordance with aspects of the present invention. Magazines 601 and 602 are shown fully inserted and locked in place (properly engaged) inside complementary cavities 606 within housing 603, which itself may be inserted into a magazine receiving section of a firearm, or may, alternatively, be an integral part of such a firearm, and provide cartridges to a firing mechanism via cartridge removal port 607. Cartridge removal port 607 variably holds cartridges within volume/feed 605 unless and until a firing mechanism or other cartridge removal action extracts them (e.g., engagement of the rear of the casing and sweeping of the cartridges into a firing chamber by an automatic slide and bolt of a firearm).

Prior to being slided into cavities 606, magazines 601 and 602 may be loaded with and retain cartridges via a variable holding mechanism which is released upon full mounting of the magazines (proper engagement) within cavities 606 and housing 603. For example, a variable retaining tab (or tabs) holding cartridges within the magazines may be cleared by a tab-clearing interfacing piece (not pictured) upon such full mounting—such as the cartridge-retaining tabs and tab clearing features discussed as 115-117 of FIG. 1. If so released, such a mechanism would then permit cartridges to be driven out of magazines 601 and 602 by followers 609 and their force-loading 611, and/or deliver upward pressure against any prior-loaded cartridges held in volume/feed 605. Prior to loading magazines such as 601 and 602, or after their unloading, cartridges already within volume/feed 605 may be retained, and still driven upward toward port 607 by compressible, flexible force-exerting bumpers 613. Bumpers 613 are preferably of an elastomeric or omni-directional force loaded materials and attached to inside walls of volume/feed 605 and housing 603, at locations that permit the upward passage of cartridges (with help from magazine followers 609, past the bumpers) but then oppose downward movement of such cartridges within volume/feed 605 and, through post-passage rebound, expand below such cartridges, driving them toward port 609. Bumpers 613 may alternatively be comprised of a more rigid surface material, but also comprise force-loading to achieve the same post-cartridge passage driving and retention, or accomplish those actions by any known method in the art.

A feed line selector 615, which leads cartridges from one magazine at a time to flow upward in reaction to cartridges being removed from port 607, is mounted near the center-bottom of and within volume/feed 605. Selector 615 is biased toward one of two rotational positions, defined by an attached lever 616 mounted on a common rotational axis 619 as it travels within a confining pocket 621 in an outside surface of the housing 603. Expansionary force-biasing 623 rotationally attached to both the end of lever 616 and, at the force-biasing's other end, at a point in the housing, tends to push lever 616 to one of two extreme positions against the outer walls of pocket 621, each corresponding with selecting one of two magazine feeds to flow upwards and holding rounds in the other. While both magazines are loaded and pressing cartridges upward toward volume/feed 605, selector 615 will tend to retain its latest selector position, allowing the flow of cartridges from one, but not the other, magazine, due to the action of force-biasing 623, which is sufficiently strong, with the action of the flowing cartridges to withhold cartridges from the retained cartridges. If, however, one of the magazines has been emptied after serving as the source for that flow, the selector will be driven into the opposite position, allowing cartridges to flow from the other magazine into the volume/feed 605, due to the absence of the additional pressure from the previously flowing cartridges. Further, either magazine, upon emptying, preferably will be immediately released by follower-actuated, force-biased magazine catch mechanisms 624, mounted in the housing 603. Force-biasing 625 within those mechanisms 624 cause interlocking members 627 to be forced within complementary holes within the housings of magazines 601 and 602. However, as the followers of the magazines rise with emptying, due to their own upward force-biasing 611, unlocking sub-features 629 depress and push out members 627, due to their outward-extending, sloped shapes, causing the magazine to be released downward by gravity from housing 603 upon release of the last round from the magazine into volume/feed 605. Windows 635 at the bottom of pocket 621 may also allow additional follower sub-features 633 to push lever 616 away from the pocket, to the opposing tack, and thereby encourage the proper selection of a cartridge feed from a remaining magazine that is still loaded with cartridges.

Figure 7:
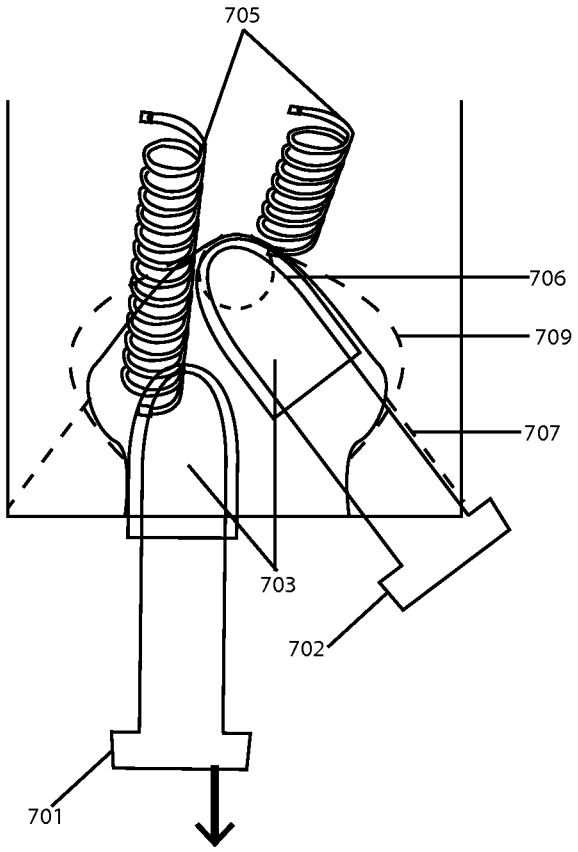
FIG. 7 is a side view of another flexible-loading ammunition system, including a set of dual, separately changeable ammunition magazines and variably-positioned magazine-receiving housings, in accordance with aspects of the present invention.

FIG. 7 is a side view of another flexible-loading ammunition system, including a set of dual, separately changeable ammunition magazines 701 and 702 and variably-positioned magazine-engaging housings 703, in accordance with aspects of the present invention. Upward force-biasing, such as springs 705, drive housings 703 upward, toward engagement with a firing chamber loading port 706 and/or a mechanism for drawing cartridges from a magazine mounted in the housings, creating a direct feed of ammunition to the firing chamber. However, only one such housing 703, which itself must be occupied by a loaded magazine, may occupy the engagement position at a time, which engagement position is illustrated by the right-hand-side magazine 702 and right-hand-side housing 703 with which 702 is shown engaged. If no longer loaded with a magazine, for example, due to recent ejection or other detachment of that magazine, such a housing automatically clears the firing engagement position because the magazine no longer holds the housing in place against a wall feature 707 retaining that position (and, in some embodiments, the system may forcibly eject such a magazine upon emptying). As a result, housing 703 may then be pulled into a channel defined by wall 709 (because it is no longer held away from it by the engaged magazine), which channel then would lead the right-hand housing 703 to be pulled out of the engagement position and into a position open for receiving a new magazine. At that point, the other, left-hand, housing 703 may enter the firing engagement position, if it has been loaded with a magazine and pulled back into a starting position, shown by 701, which leads to channel(s) leading to a position of engagement with the chamber port 706. As in other embodiments discussed in this application, preferably, upon emptying, magazines 701 and 702 cause themselves to be released from a variable interlocking mechanism with their housings, 703 or may, as discussed above, be forcibly ejected by the system. In addition, any of the movements discussed above may be alternatively forcibly actuated with any known method or apparatae in the art, including, but not limited to or server motor actuation by a control system, such as a computer and/or processor in actuating connection with such servo motors (not pictured).

Figure 8:
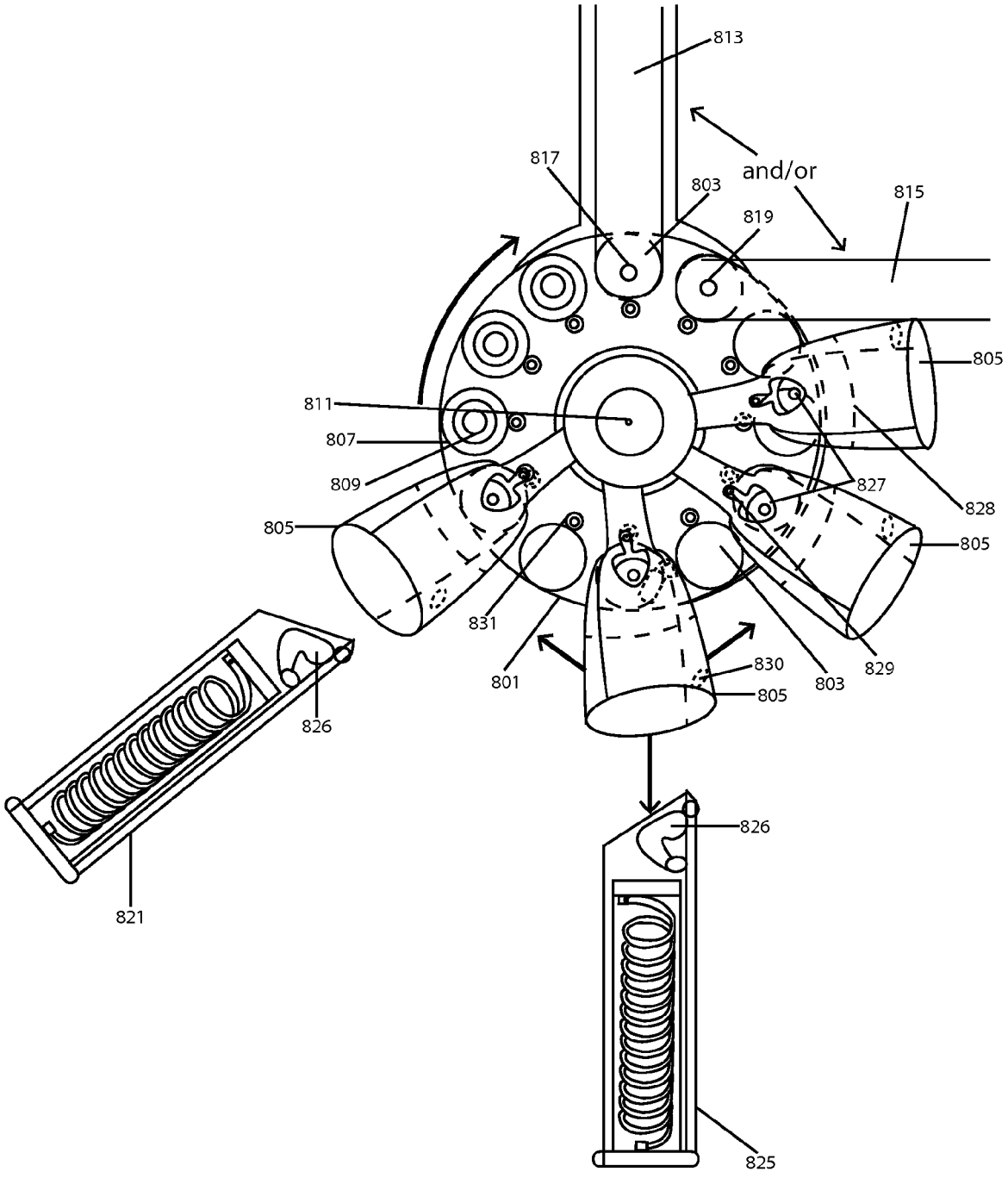
FIG. 8 is a depiction of aspects of another flexible-loading ammunition system, including a rotatable cylindrical set of transposable firing chambers, that may be variably loaded by magazine feeding leaves.

FIG. 8 is a depiction of aspects of another flexible-loading ammunition system, including a rotatable cylindrical set 801 of transposable firing chambers, such as those examples shown as 803, that may be variably loaded by magazine-feeding swinging holders 805. Certain of the firing chambers, such as chamber 807, are shown filled with an ammunition cartridge, such as 809, and the figure provides a rear (butt-end) view of such the chambers and loaded cartridges. The cylindrical set of chambers 801 may rotate about an axis 811, and a firing mechanism and/or action (or multiple mechanisms and/or actions) such as those partially depicted as 813 and/or 815, may cause the clockwise rotation (facing the figure) of set 801, such that a new, loaded chamber, if available, is engaged with the either or both firing mechanisms and a rifled barrel prior to firing. Firing pin(s), such as those shown as 817 and/or 819, may be caused to strike the rear, primed section of cartridges upon such firing.

Swinging holders 805 may swing on rotating joints about the same axis, 811, on which cylindrical set 801 rotates. Holders 805 may variably engage with exchangeable magazines, such as those examples pictured as 821 and 825, for example, by any of the interlocking and engagement mechanisms for magazines discussed elsewhere in this application, or by engagement-driven hooks or tabs, such as those shown as 826 that may pop-out of the magazines and interface with ports in holders 805, such as that shown as 830. Holders 805 may comprise sliding cartridge advancers, such as those examples pictured as 827. Such cartridge advancers may slide in the direction into the page (of the figure) with a physical edge that, in so sliding, catches a top-most cartridge in a conventional ammunition magazine, removing it from the magazine and inserting it into an empty firing chamber, such as those pictured as 803, through a holder window, such as 828, in the set 801-facing side of the holder (into the page), if and when set 801 moves such an empty chamber past such a window 828 of a holder 805. Cartridge advancers 827 may each include attached advancement permitting/reversing pins 829 that allow such cartridge insertions by entering pin holes 831, but which holes force the pins 829 and advancers 827 back (toward a viewer of the figure) after so inserting a cartridge (for example, by a force-loaded rod that forces any pin 829 back out after loading). Such force-loaded rods may be reset, deeper into the holes 831, to accept pins 829 again by gearing or channeling driven by further rotation of the set 801, but only when the immediately neighboring chamber is empty. In any event, the rod action pushing pins 829 out of holes 831 resets the force-loaded cartridge loading action of advancers 827 behind the next cartridge, emerging at the top of the magazine in place of the last removed top-most cartridge. Because the casings of the cartridges include a rear lip wider than the remainder of the cartridge, and wider than chambers 803, such cartridges loaded in chambers 803 are then ready for striking by firing mechanisms 813 and/or 815 by opposing a strike by firing pins 817 and/or 819. Also because of those structural lips and/or the presence of an emerged, pin-removing rod within a hole 831, advancers 827 will not move additional rounds into a chamber that has already been loaded, and, instead, holders 805 with conjoined magazines will pass over such loaded chambers, and proceed to load adjacent empty chambers, if any, that next pass under them.

Magazines, such as those pictured as 821 and 825, may variably and releasably conjoin with holders 805 according to aspects discussed elsewhere in this application, for variably conjoining and releasing magazines to other structural parts (for example, as discussed in reference to FIG. 6), or by any other methods for conjoining and releasing magazines known in the art. Again, it should be noted that the particular mechanisms depicted are illustrative only, and are not exhaustive of the techniques within the scope of the invention. For example, a mechanism whereby cartridges automatically are advanced from magazines after proper engagement, such as the techniques discussed in reference to FIG. 1, may be used, rather than the advancer system discussed in reference to this figure.

Figure 9:
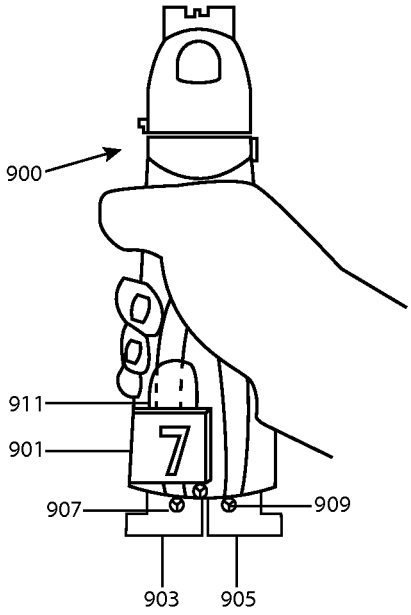
FIG. 9 depicts a magazine-communicating firearm system which may be used, for example, as a part of multiple-magazine, flexible-loading firearm and firearm antechamber systems, such as those described in reference to FIGS. 7, 8 and 10, according to aspects of the present invention.

FIG. 9 depicts a magazine-communicating firearm system 900 which may be used as a part of multiple magazine, flexibly-loading firearm and firearm antechamber systems, according to aspects of the present invention. If used in a handgun, a shot-counting display 901 preferably is placed on lower left-hand (and/or, if the user is or may be left-handed, on the lower right-hand) and at least partially rearward and/or user's eye-ward facing sides of the handle. However, in any firearm, such a display is preferably placed on an eye-ward facing surface, or within an otherwise rapidly-acquired user interface (such as, but not limited to, user interfaces that may be within a site and/or a goggle or eye-shield heads-up display). Each or any loaded magazine, such as those shown as 903 and 905, loaded into firearm system 900, contain communication-enabling elements, such as those examples shown as 907 and 909, which may communicate both with internal sensors and/or a processing system 911, which contains a computer, memory, software, logic/state machine and/or processors, and also is in communication with and able to control the output of display 901. Elements 907 and/or 909 may, for example, comprise physical contacts that, when connected upon engagement of one or more magazines such as 903 and 905, lead to initiation of communication. Alternatively, elements 907 and/or 909 may comprise antennae or other radio frequency and ambient power delivery and recognition aspects, for initiation of communication. System 911 may also be in communication with motion sensors and/or antechamber sensors, which aid in counting or inventory of shots fired and/or cartridges loaded or depleted within a magazine(s), an antechamber(s) and/or firing chamber(s), such as those magazines, antechambers and firing chambers discussed elsewhere in this application. In addition, system 911 may, with or without the aid of a battery and electromagnetic or electric power transferring elements, power sensors and communication units 903 and 905, in addition to communicating with them. System 911 and any associated batteries and/or capacitors may also be charged by motion driven or ambient power capturing sources, such that the loading, recoil or other firearm actions and movements of the firearm may recharge the system, obviating the need for battery changes or other external powering which may, alternatively, be used in accordance with aspects of the invention. In any event, through such system 911, and any such sensors or inventory count-down techniques, a current accurate count of available ammunition in the firearm for firing may be relayed to a user of the firearm (as pictured) as well as the identity of the currently used magazine and/or the available ammunition per magazine (not pictured).

System 911 may include software that may maintain an accurate count of available rounds for firing, magazine status, and other firearm data (e.g., drag from machine debris related to potential jamming, overheating or current barrel temperature, from such sensors) and may be resettable, calibratable or otherwise count- or other output-manipulable by a user and/or ordinary actions of system 900. For example, upon ejection of one or both magazines, the system may remove any count of cartridges from that magazine from its total count of available rounds, and may, in lieu of internal magazine sensors, add a standard number of rounds upon detecting the loading of the next magazine loaded to the total count. As another example, a user interface may be used to adjust any settings and enter any such necessary user/system selections and data.

Figure 10:
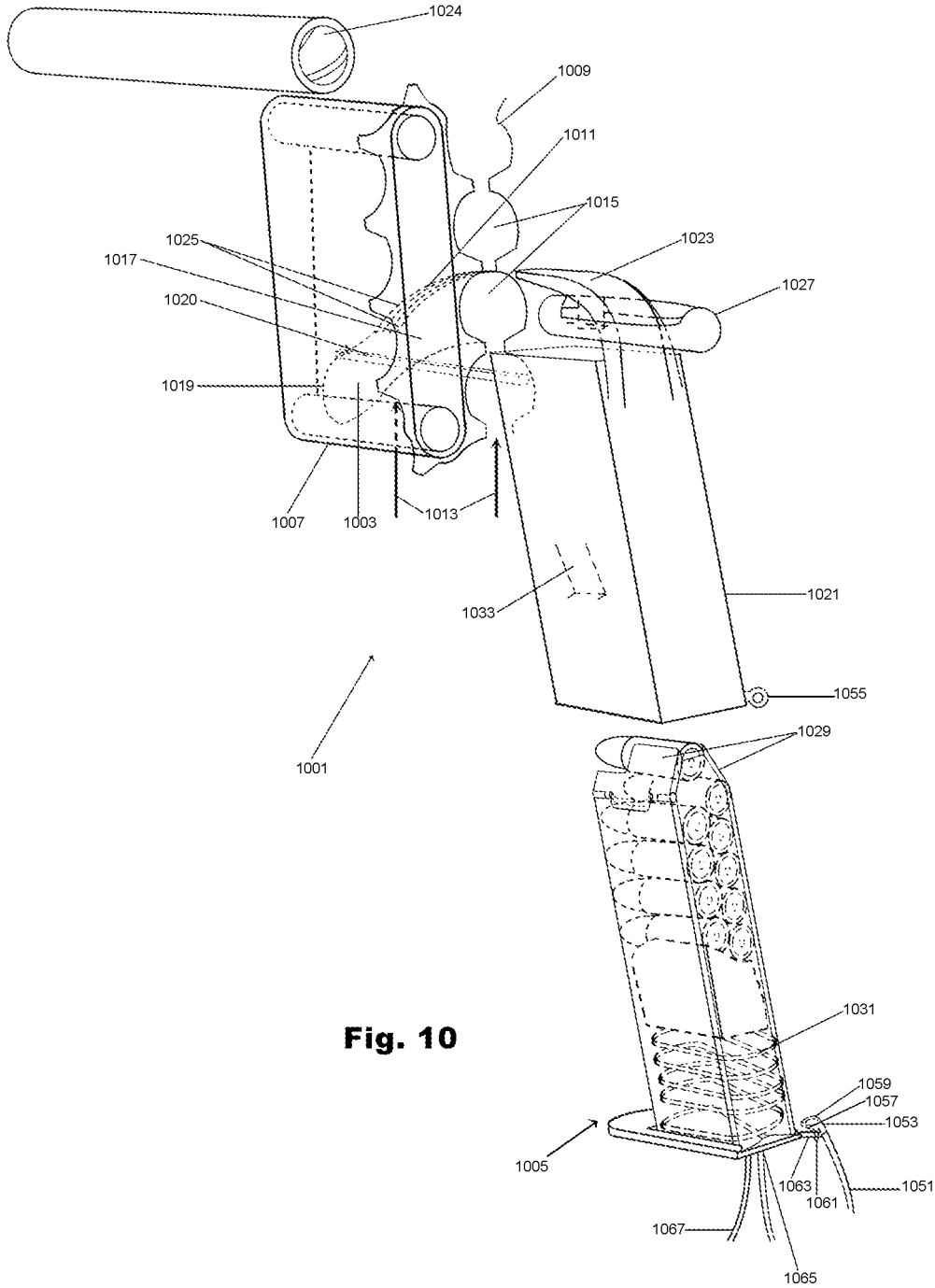
FIG. 10 depicts aspects of another flexible-loading ammunition system, including belt-driven and -defined pre-firing cartridge advancement intermediate chambers and the use of exchangeable magazines.

FIG. 10 depicts aspects of another flexible-loading ammunition system 1001, including belt-movable and -defined pre-firing cartridge advancement intermediate chambers, such as that shown as chamber 1003, and also including the use of exchangeable magazines, such as that shown as 1005. A set of two belts, including a left-hand-side belt 1007, pictured, and a right-hand-side belt 1009, partially pictured, comprise movable chamber-defining wall contours, such as those partially depicted by contour 1011. (To aid the viewer by avoiding confusion from many intersecting lines in the figure, the contours for only one exemplary chamber, 1003, are fully shown in FIG. 10.) More specifically, the inner-facing surfaces of left conveyor belt 1007 and right conveyor belt 1009 converge, but need not completely touch one another, along a separation plane depicted by arrows 1013. However, it should be understood that a movable, variable series of such chambers in parallel configurations, above and below, are present along that plane where the inner-facing surfaces of belts 1007 and 1009 lay next to one another. Each such chamber may comprise, in part, a cartridge entry port, such as those shown as 1015, a downward curving tunnel, such as that shown as 1017, and an exit port, such as that partially shown as 1019. As will be explained in greater detail below, cartridges may be fed into such entry ports and, depending on the embodiment of the invention, may, in so doing drive both belts 1007 and 1009 upward (on the side of each belt facing one another) delivering such driving force from a support rod 1020, attached, for example, to intermediate magazine-accepting and cartridge-advancing and feeding housing, 1021. A cartridge reaching the top of the convergences of the inner-facing surfaces of belts 1007 and 1009 may be driven upward to that position by lower cartridges entering lower ports and their respective tunnels from magazine 1005 and intermediate housing 1021, and thereby delivering force to the upper (ceiling) contours of the belt-defined tunnels (such as 1003). However, a cartridge-inserting and -clearing semiautomatic or automatic action bolt, chambered cartridge and/or other such member may be present, and therefore resist further upward movement of a top-most cartridge held by belts 1007 and 1009 (or may resist contours of the walls themselves, or gearing features of or related to the belts' movement). In any event, further movement of the belts is arrested until such time as a firing and clearing action, removing such members, takes place. Alternatively, or in addition, a firing and/or recoil actuated cartridge driver (discussed below) may also or alternatively halt or advance the next lower cartridge in the magazine from housing 1021 through outward guide 1023 until the next, empty belt-defined chamber has been raised to the level of the position of a cartridge exiting housing 1021, along the bottom of guide 1023, rather than rely on force biasing of cartridges pushed into empty chambers, such as 1003.

By holding cartridges and advancing them only upon firing action, in a sense, belts 1007 and 1009 may serve as an intermediate set of storage chambers, ancillary to storage by the magazine. Preferably, auxiliary force-loading of the belts' movement, or action-driven gearing of them, will lead to the advancement of cartridges within the belt-defined chambers, such as 1017, and enable further firing even if a magazine, such as 1005, is no longer loaded into intermediate housing 1021 and providing force-bias drive to the belts. In an alternative embodiment, aspects of which are also, alternatively, pictured, the chambering of rounds by a bolt or other action (not pictured) may occur at a position lower than that of the top of the belts and barrel/firing chamber, 1024, such that, upon sweeping a cartridge into barrel or pre-barrel chamber, such as 1024, the resulting force against cartridge top-pressing ceiling features (such as those pictured as 1025) itself results in driving the belts upward, and preparing the next lower cartridge for loading.

Any number of interchangeable ammunition storage magazines, such as that pictured as 1005, may be used in some embodiments and aspects of the system 1001, including, but not limited to, conventional magazines. When loaded into intermediate housing 1021, cartridges may exit the magazine 1005 and housing 1021 toward the belts' (1007 and 1009) inward convergence and, preferably, a firing and/or recoil actuated cartridge driver 1027 drives each cartridge separately into an empty belt-defined chamber and may, as mentioned above, halt the further advance of cartridges held below, in the magazine, unless and until a new, empty belt-defined chamber is presented at the level of the driver 1027. If conventional magazines are used, driver 1027 must be of a type shaped to catch the back of casings of cartridges exposed through casing-griping ears, such as those shown as 1029, such that the driver may unload such a conventional magazine. But, preferably, a specialized magazine with force-biased but spreadable ears (e.g., to be opened upon engagement with the housing), pictured as 1029, is used. In that embodiment, the cartridges need not be unloaded from the magazine, such as 1005, by a driver 1027 and the force from a magazine's force-loading, such as spring 1031, along with leaf-spreading tabs 1033, within the housing 1021, lead to loading cartridges into ports, such as those pictured as 1015. However, for such an embodiment to work, cartridges must be substantially larger than that pictured in FIG. 10, such that they fully occupy the belt-defined chambers, such as 1003, and resist the further loading of cartridges until already loaded cartridges have been advanced upward from the loading position. Such loaded cartridges will resist further loading with the aid of a wall (not pictured) blocking the exit ports, such as that pictured as 1019, and unless and until the back-pressure from the loaded cartridges is cleared by loaded cartridges advancing upward, which they may do until the firing chamber or bolt is reached. If force-biasing is not used to drive the belts, and the upward pressure of cartridges being swept out of the belts is also not used to used to drive belts, the chambers, such as that shown as 1003, need not be curved.

In the event of firing without a loaded magazine—which may be useful in the field, for example, in the event of interrupted loading by combat circumstances—at least temporarily empty belt-defined chambers may result, which may be thought of as firing gaps. To aid in filling such gaps, multiple outward-flowing channels, similar to those discussed in reference to FIG. 5, may be used, especially in relation to the embodiment discussed immediately above, if a higher position for the top most housing exit guide 1023, is used, with parallel, lower housing guides with partly open roofs, that allow upward passage of cartridges, unless and until back pressure from a loaded cartridge resists loading at that position.

Because several embodiments described in the present application may implement system-directed ejection of ammunition storage magazines, after empty, without the further aspects discussed below, they may create an issue of lost or mishandled empty magazines, depending on the alertness, experience and goals of the user. Most conventional firearms do not cause ejection of magazines after empty, and some embodiments of the present invention do not either. However, preferably, at least a partial ejection of emptied magazines occurs, to alert a user with a tangible physical change that a magazine has been emptied, much as a last shot "locked open" bolt may signal emptying of an entire firearm, in some automatic firearms. For example, when emptied, a magazine may disengage and shift its position, but not fully drop from the weapon, with the aid of stays, partially-ejected position tabs or attached cords that catch the disengaged magazine, or channel/wall features that temporarily hold the magazine in a disengaged, partially ejected position. In one embodiment, partially pictured in FIG. 10, such a cord or stay 1051 is shown attached both to the magazine 1005 base and an eyelet-capturing spreadable snap 1053. Snap 1053 and interfacing eyelet 1055 are each located on the lower-right-hand-side of a housing—the housing of magazine 1005 and the cartridge-advancing and feeding housing 1021, respectively. As a magazine such as 1005 is slid into its proper engagement position, within housing 1021, surrounding snap members 1057 and 1059, which preferably have rounded interfacing surfaces, snap into place and conjoin with eyelet 1055 by spreading over eyelet 1055's outer ring structure and entering the void at its center. Snap 1053 is preferably at least semi-permanently attached to cord or stay 1051, but temporarily held into its place at the lower-right-hand-side of the housing of magazine 1005, such that, if magazine 1005 is ejected from housing 1021, snap 1053 remains attached to eyelet 1055 and, therefore, housing 1021. But, because snap 1053 is only temporarily directly held to the housing of magazine 1005 (for example, by accepting a pin 1061, which is attached to snap 1053, downwardly-inserted into a pin acceptor 1063) snap 1053 will not follow magazine 1005 down as it is ejected. Because cord 1051 is attached to both by attachment point 1065 with magazine housing 1005 and eyelet 1055 of housing 1021, the magazine 1005, resultantly, remains indirectly attached to housing 1021 after ejection via stay/cord 1051. Preferably, snap 1053 is held in place conjoined to eyelet 1055 with sufficient strength to retain its connection even after absorbing the full force of the falling magazine, but is impermanent enough to allow a user to pull the snap loose. Also preferably, stay/cord 1061 is sufficiently long to permit the ejected magazine 1005 to fully clear housing 1021, and leave it open for insertion of a new magazine, but, in some embodiments, full ejection, and such long cords or stays, may not be preferred. As with all other described embodiments in this application, the particular stay implemented is by no means exhaustive of the many alternative possibilities within the scope of the present invention, and other stay mechanisms, such as flexible interior housing tabs, snaps, channels or other stays may, alternatively, be used. Finally, a cord 1067 may connect magazine 1005 with another attachment point, or even a winch or other play-gathering device that detects when a magazine has been ejected, reels it in and sequesters it. Such a device may include a processor, memory, software, sensors and/or actuators and may comprise padding where the magazine comes to a rest after being reeled in (e.g., on a soldier's belt or other equipment) to absorb the shock of the magazine and hold it in place after it is ejected. As one alternative, cord 1067 may be at least partially around a user's neck and/or shoulder to avoid losing the magazine, preferably by a variable loop which may be defined by a floating, cinching and gripping ring, and may let more than one cord attach to a magazine, or any other retained equipment, at multiple locations on the equipment.

I claim:

1. A flexible loading ammunition system, comprising an intermediate ammunition cartridge storage device that is able to store and cause ammunition cartridges to move for placement in a firing mechanism and which, while installed on a firearm, is also able to be manually coupled and decoupled with at least one ammunition-delivering magazine and, when so coupled, is able to receive from said at least one ammunition-delivering magazine the amount of ammunition necessary to complete loading said intermediate ammunition cartridge storage device if sufficient ammunition to do so is available in said at least one ammunition-delivering magazine.

2. The flexible loading ammunition system of claim 1, further comprising in which said firing mechanism is able to receive cartridges by an energy storage source present in said at least one ammunition-delivering magazine.

3. The flexible loading ammunition system of claim 1, further comprising where said firing mechanism is able to receive at least one cartridge by a cartridge conveyance device comprising at least one raisable one-way cartridge-holding member.

4. The flexible loading ammunition system of claim 1, further comprising at least one user-actuable lock for altering the coupling state of said intermediate storage device and said at least one ammunition-delivering magazine.

5. The flexible loading ammunition system of claim 3, in which said at least one ammunition-delivering magazine further comprises at least one cartridge-retaining device, at least one of which at least one device can resist the escape of at least one cartridge from said at least one ammunition-delivering magazine.

6. The flexible loading ammunition system of claim 5, in which said at least one cartridge-retaining device further comprises an energy storage device and in which said at least one ammunition-delivering magazine can be opened with the aid of an attached lever.

7. The flexible loading ammunition system of claim 1, further comprising a shot counting system comprising at least one shot inventory device and at least one inventory information transmission device.

8. A flexible loading ammunition system for a firearm, comprising multiple simultaneous ammunition-delivering magazine engagement capability, in which a user may select one ammunition-delivering magazine coupled with a firearm, causing said one ammunition-delivering magazine to provide cartridges for the firearm, and further comprising a magazine-to-firing-mechanism feed device, which is able to be supplemented from said one ammunition-delivering magazine until said one ammunition-delivering magazine is depleted, and thereafter is able to be supplemented from another ammunition-delivering magazine, if loaded with at least one cartridge and coupled with the firearm for delivery of at least one cartridge to the firearm.

9. The flexible loading ammunition system of claim 8, further comprising where said feed is able to receive at least one cartridge by force-loading from at least one ammunition-delivering magazine.

10. The flexible loading ammunition system of claim 8, further comprising where said feed device and said firing mechanism are able to receive at least one cartridge by a feed selector and advancement device comprised in an area comprised in the firearm.

11. The flexible loading ammunition system of claim 8, further comprising at least one user-actuable lock for altering the coupling state of ammunition-delivering magazines and said firearm.

12. The flexible loading ammunition system of claim 10, in which at least one ammunition-delivering magazine is comprised in the system and further comprises at least one cartridge-retaining device, at least one of which at least one device can resist the escape of at least one cartridge from said at least one ammunition-delivering magazine.

13. The flexible loading ammunition system of claim 12, in which said at least one cartridge-retaining device further comprises force-loading and in which said at least one ammunition-delivering magazine can be opened with the aid of an attached lever.

14. The flexible loading ammunition system of claim 8, further comprising a shot counting system comprising at least one ammunition inventory device and at least one inventory information transmission device.

15. A flexible loading ammunition system, comprising an intermediate storage device that is able to store and cause ammunition components to cycle for firing placement by a firearm action and which intermediate storage device is able to be manually coupled with at least one ammunition-delivering magazine and, when so coupled, is able to receive from said at least one ammunition-delivering magazine ammunition necessary to load said intermediate storage device, at a plurality of ammunition component loading positions of said intermediate storage device, if sufficient ammunition to do so is available in said at least one ammunition-delivering magazine.

16. The flexible loading ammunition system of claim 15, further comprising in which said intermediate storage device is able to receive cartridges by at least one energy storage source present in at least one ammunition-delivering magazines.

17. The flexible loading ammunition system of claim 15, further comprising where said intermediate storage device is able to receive ammunition by a device comprising at least one feed selector, and is able to receive ammunition by an ammunition advancement device.

18. The flexible loading ammunition system of claim 15, further comprising at least one user-actuable release for changing the coupling state of said intermediate storage device and said at least one ammunition-delivering magazine.

19. The flexible loading ammunition system of claim 17, in which said at least one ammunition-delivering magazine further comprises at least one ammunition-retaining device, at least one of which at least one ammunition-retaining device can resist the escape of at least part of one ammunition component from said at least one ammunition-delivering magazine.

20. The flexible loading ammunition system of claim 19, in which said at least one ammunition component-retaining device further comprises force-loading and in which said at least one ammunition-delivering magazine can be opened with the aid of an attached lever.

* * * * *